US009441383B2

(12) United States Patent
Wang et al.

(10) Patent No.: US 9,441,383 B2
(45) Date of Patent: Sep. 13, 2016

(54) CONSTRUCTION APPARATUS AND METHOD FOR LIFTING STRUCTURE INTEGRALLY OVER THE OBSTACLES IN VERTICAL DIRECTION TO A POSITION WITH DIFFERENT HORIZONTAL PROJECTION

(71) Applicants: Guangzhou Construction Engineering Co., Ltd., Guangzhou (CN); Shanghai YeSheng Mechanical & Electrical Control Technology Co., LTD, Shanghai (CN)

(72) Inventors: Long Wang, Guangzhou (CN); Wei Wei, Shanghai (CN); Junyue Gao, Guangzhou (CN); Jianming Wen, Shanghai (CN); Sui Yin, Guangzhou (CN); Yuantao Zhao, Shanghai (CN); Yanfeng Jia, Shanghai (CN)

(73) Assignees: GUANGZHOU CONSTRUCTION ENGINEERING CO., LTD, Guangzhou (CN); SHANGHAI YESHENG MECHANICAL & ELECTRICAL CONTROL TECHNOLOGY CO., LTD, Shanghai (CN)

( * ) Notice: Subject to any disclaimer, the term of this patent is extended or adjusted under 35 U.S.C. 154(b) by 328 days.

(21) Appl. No.: 14/032,928

(22) Filed: Sep. 20, 2013

(65) Prior Publication Data

US 2014/0346131 A1 Nov. 27, 2014

(30) Foreign Application Priority Data

May 23, 2013 (CN) ..... 2013 1 0196541

(51) Int. Cl.
*B66C 17/06* (2006.01)
*E04G 21/16* (2006.01)

(52) U.S. Cl.
CPC ..... *E04G 21/167* (2013.01); *B66C 17/06* (2013.01)

(58) Field of Classification Search
CPC ..... B66C 5/00; B66C 5/02; B66C 5/04; B66C 5/06; B66C 17/00–17/26; B66C 19/00–19/02; B66C 11/16; E04G 21/14; E04G 21/16; E04G 21/167
USPC ..... 212/312, 319, 324
See application file for complete search history.

(56) References Cited

U.S. PATENT DOCUMENTS

| | | | | |
|---|---|---|---|---|
| 3,176,853 A * | 4/1965 | Baudhuin | B66C 1/223 | 212/326 |
| 3,792,779 A * | 2/1974 | Brazell | B60K 17/10 | 212/283 |
| 5,715,958 A * | 2/1998 | Feider | B66C 1/101 | 212/273 |
| 6,030,168 A * | 2/2000 | Kroll | B66C 13/06 | 212/273 |

FOREIGN PATENT DOCUMENTS

| | | |
|---|---|---|
| CN | 101328765 A | 12/2008 |
| CN | 201649671 U | 11/2010 |
| CN | 102490643 A | 6/2012 |

* cited by examiner

*Primary Examiner* — Sang Kim
*Assistant Examiner* — Juan Campos, Jr.
(74) *Attorney, Agent, or Firm* — Muncy, Geissler, Olds & Lowe, P.C.

(57) ABSTRACT

The present invention disclosed a construction apparatus and method for lifting structure integrally over the obstacles in vertical direction to a position with different horizontal projection. The apparatus comprises two platform beams placed each other in parallel, two lifting beams laterally relative to the platform beams and a lifter equipped with the lifting beams. Push instrument kits are installed on the platform beams and the lifting beams respectively, and a plurality of sets of baffles installed on both sides of the platform beams to provide the push instrument kits with a counter-force when the push instrument kits work. When the structure encounters obstacles during the process of lifting the structure by two lifters, the posture of the structure can be altered by operating the push instrument kits and the lifters, such that the horizontal projection of the structure will be reduced and the structure can therefore be lifted over the obstacle in vertical direction.

6 Claims, 8 Drawing Sheets

CONSTRUCTION APPARATUS AND METHOD FOR LIFTING STRUCTURE INTEGRALLY OVER THE OBSTACLES IN VERTICAL DIRECTION TO A POSITION WITH DIFFERENT HORIZONTAL PROJECTION

CROSS REFERENCE TO RELATED APPLICATIONS

This application claims priority of Application No. 201310196541.1 filed in China on May 23, 2013, under 35 U.S.C. §119, the entire contents of which are hereby incorporated by reference.

FIELD OF TECHNOLOGY

The present invention relates to a field about construction apparatus of civil engineering, in particular a construction apparatus and method for lifting structure integrally over the obstacles in vertical direction to a position with different horizontal projection.

BACKGROUND OF THE INVENTION

With the development of society, and the increase of labor cost, negative influence of traditional construction model shows all the time, that is, high-altitude working has much potential risk and long construction period, whose construction quality is very hard to be guaranteed and project cost stays at a high level.

Therefore construction method of lifting integrally transforms high-altitude working into ground operation, which greatly reduces potential safety hazard, improves working environment, ensures construction quality, and realizes prefabrication and mechanization of structure installation. Also it enormously betters construction efficiency, construction quality and security of construction procedure of this kind of structure construction. It is especially important and meaningful to current structure construction under circumstance of raising labor cost and tight schedule. It has positive significance to change present construction production from labor-intensive, extensive and backward construction mode into technology-intensive, intensification and advanced construction mode.

However, existing integrally lifting construction methods are mostly performed in good condition of lifting point layout and construction environment. There is no corresponding integrally lifting construction method for installation in other conditions where the obstacles in vertical direction exists or initial lifting position and emplacement position of the structure have different horizontal projections. In this case an assembly in bulk in high altitude is often adopted, but such way has following disadvantages:

(1) Large quantity of high-altitude working, high safety hazard, and difficulty to carry out the safety protection;

(2) Bad environment condition for welding as high-altitude working, which makes it hard to guarantee construction quality;

(3) Large quantity of high-altitude working, bad operational environment condition for welding as high-altitude working, which lead to an inconvenient operation and long construction period on site.

SUMMARY OF THE INVENTION

The present invention provides a construction apparatus and method for lifting structure integrally over the obstacles in vertical direction to a position with different horizontal projection, in order to alleviate technical problems about integrally lifting when the obstacles in vertical direction exists.

With regard to the solution for the above defects, the present invention provides the following:

A construction apparatus for lifting structure integrally over the obstacles in vertical direction to a position with different horizontal projection, according to the present invention, comprises at least two platform beams that placed each other in parallel with a certain distance, and at least two lifting beams laterally relative to the platform beams, that placed on the platform beams, and above the structure to be lifted; A slide rail is arranged on the platform beam;

A lifter is equipped on the lifting beam by means of a shoulder beam;

First push instrument kits are installed on the platform beams to move the lifting beams, each first push instrument kit comprises a head connected to the lifting beam, a body, and a base used to sustain the body;

Second push instrument kits are installed on the lifting beams to move the shoulder beams, and the lifters are installed on the should beams, each second push instrument kit comprises a head connected to the shoulder beam, a body, and a base used to sustain the body;

First set of baffles is installed on both sides of the slide rail of the platform beams, in order to provide the first push instrument kits with a counter-force when the first push instrument kits work;

Second set of baffles is installed on the lifting beams in order to provide the second push instrument kits with a counter-force when the second push instrument kits work.

Further, for the sake of controlling a pace of the push instrument kit, the first set of baffles comprises a plurality of pair of baffles being at intervals, wherein two baffles of each pair are set on both sides of the slide rail respectively; The second set of baffles comprises a plurality of pair of baffles being at interval, two baffles of each pair are set on top surface of the lifting beams.

Further, with the purpose of making the structure more stable, the shoulder beam is a box structure equipped with a via hole, the connecting ear-plates and the bound plates, wherein a steel strand can pass through the via hole, and the connecting ear-plate is configured at the sides of the box structure and spread outward to connect to the second push instrument kit, and a bound plate is configured at the bottom of the box structure.

To facilitate the push instrument kit moving, the base of second push instrument kit comprises a base body, expansion members placed at both sides of the base body, and ear-plates spread outward from the base body that used to connect to the push instrument body; The base of the push instrument kit is "H"-shaped and its width is less than the distance between two baffles of each pair baffle set on the lifting beam, and the expansion members are "H"-shaped and extend outward to be supported on the pair of baffles on the lifting beam.

Further, to facilitate the lifting beam moving, the slide rail comprises a slide groove fixed to the platform beam, and a slider fixed to the lifting beam, the slider can be slid in the slide groove, the accessible area between the slider and the slide groove is smooth plane with polishing treatment and lubricating grease.

The lifting beams are double-beams structure which are combined by two strips of "工"-shaped steel, ear-plates used to connect to the first push instrument kits are arranged on the lifting beams.

Moreover, in order to prevent the steel strand from folding while lifting the structure, due to its delay relative to the move of the push instrument kit, a rotatable support is arranged between the shoulder beam and the lifter, the rotatable support comprises spherical convex fixed to the base of the lifter, and load-bearing member fixed to the surface of the shoulder beam. The load-bearing member has a spherical concave facing to and matching with the spherical convex.

A method for lifting structure integrally over the obstacles in vertical direction moving the same horizontally, comprising the steps of:

(1) assembling the structure to be lifted on the proper position of a construction site and setting lifting lugs onto the suitable positions of the structure according to the construction requirements;

(2) arranging two platform beams longitudinally above the structure to be lifted, setting a slide rail to each platform beam, and fixing a slide groove 61 to each platform beam;

(3) placing two lifting beams on the platform beams laterally, Fixing a slider onto the bottom of the lifting beam, and the slider will be placed into the slide groove correspondently;

(4) Installing first hydraulic push instrument kits on the platform beams, wherein the head of the push instrument kit is connected to the lifting beam, the body of the push instrument kit is connected to the base of the push instrument kit which is supported on the corresponding baffles on both sides of platform beam.

(5) Installing shoulder beams and second hydraulic push instrument kits onto the lifting beams, wherein the head of the push instrument kit is connected to the shoulder beam, the body of the push instrument kit is connected to the base of push instrument kit which is supported on the corresponding pair of baffles on the lifting beams, and a hydraulic lifter is arranged on the shoulder beam;

(6) Connecting the hydraulic lifter to the lifting lug on the structure to be lifted by means of a lifting steel strand, while lifting the structure, the height between both ends of the structure can be increased, and the horizontal projection of the structure will be reduced only if adjusting the hydraulic lifters arranged at two lifting beams and the first hydraulic push instrument kits at two platform beams, such that the posture of the structure can be altered and the structure can therefore be lifted over the obstacle in vertical direction;

(7) Adjusting the height and the horizontal projection once again by operating the hydraulic lifters and the first hydraulic push instrument kits after the structure has already be crossed over the obstacle, and making the structure to be horizontal, then the structure can be lifted to a target height thereafter;

(8) Moving the structure to a desired position by operating second hydraulic push instrument kits, each pace of the hydraulic push instrument kits should match with the interval between two adjacent baffles installed on the lifting beam. Once the push instrument kit works to push at the shoulder beam for a stroke, two expansion members placed at both sides of the base body of the push instrument kit will be retracted, such that the push instrument kit can be taken out to next stroke, and two expansion members spread outward again to support on next pair of baffles on the next stroke, and the push instrument kit works again to push at the shoulder beam. Such operation can proceed subsequently, until the structure reaches its desired horizontal position.

(9) Adjusting the structure slightly by means of hydraulic lifter, in order to meet the requirement, and the installation of the structure will be accomplished.

Comparing with the prior art, the present invention can achieve the following advantages:

The present invention has stable structure and high automaticity, which transforms a great quantity of high-altitude working into ground operation, improves environmental condition of manual operation, reduces a potential dangerousness, shortens construction period, and ensures project quality and construction safety.

BRIEF DESCRIPTION OF THE DRAWINGS

The present invention will be further described in details hereinafter with the reference to accompanying drawings and exemplary embodiment, in which.

LIST OF REFERENCE CHARACTERS

Figure 1:
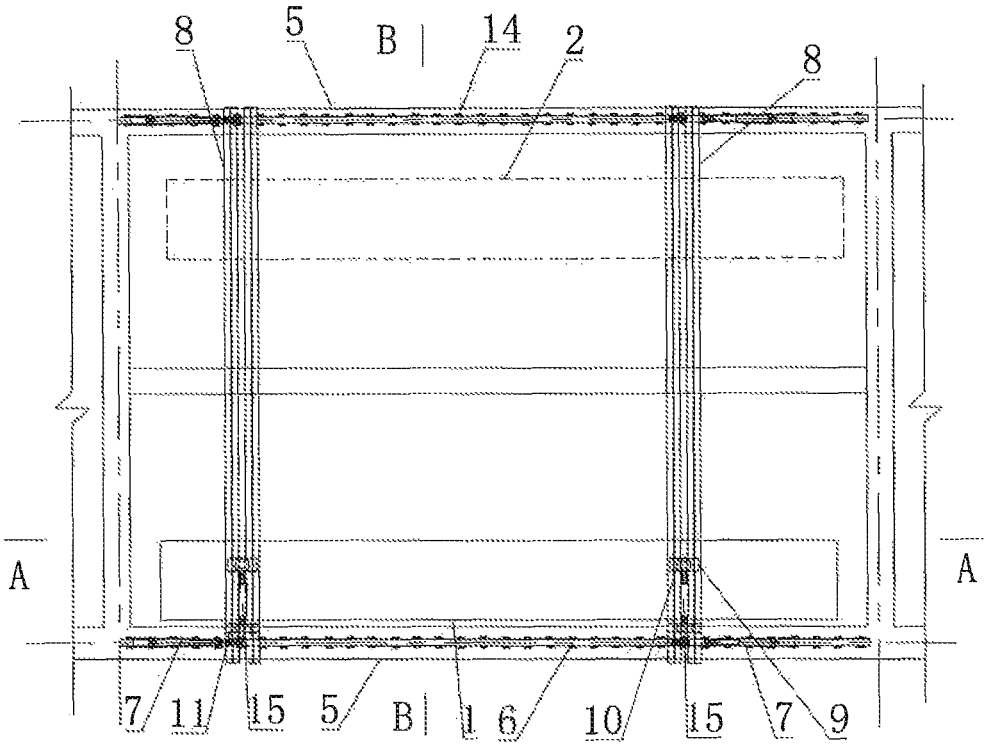
FIG. 1 is a top view according to the present invention.
Figure 2:
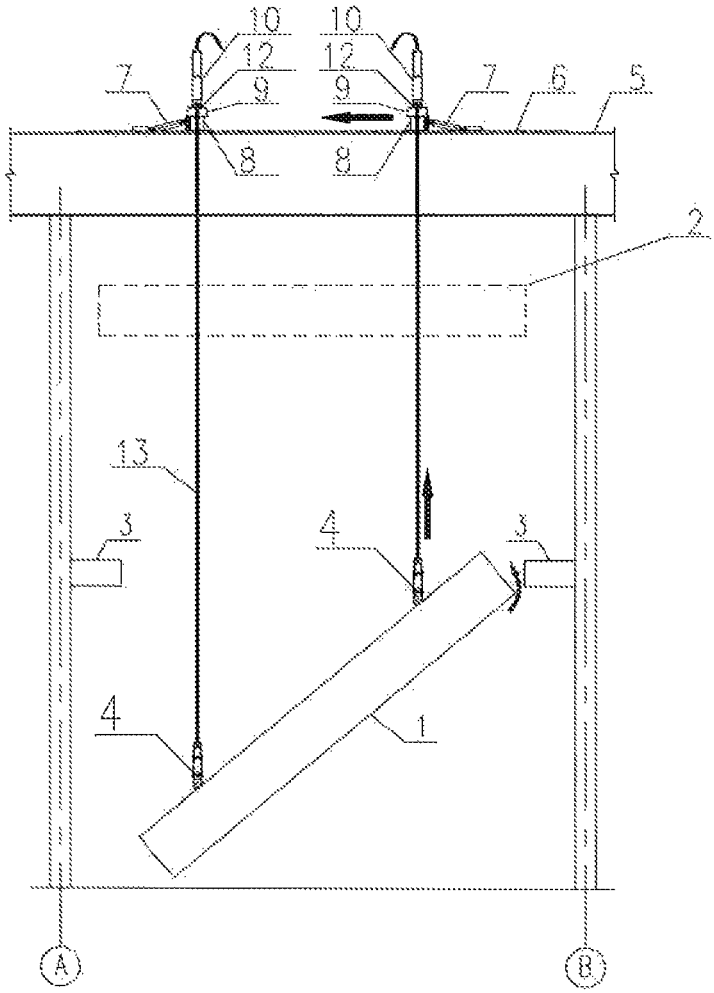
FIG. 2 is an A-A view of FIG. 1.
Figure 3:
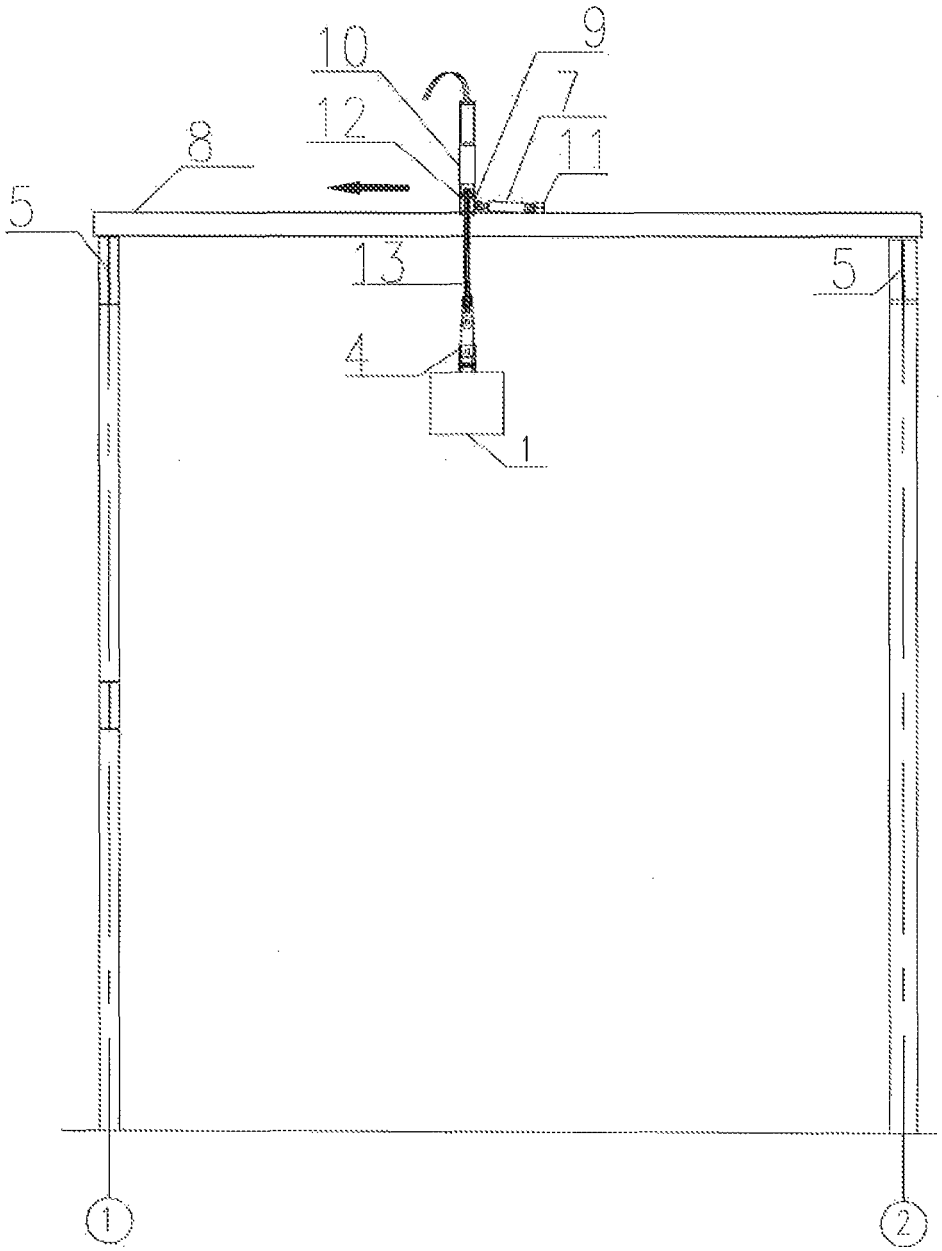
FIG. 3 is a B-B view of FIG. 1.

1 structure to be lifted
2 target position
3 obstacle in vertical direction
4 lifting lug
5 platform beam
6 slide rail
61 slide groove
62 slider
7 first hydraulic push instrument kit
8 lifting beam
81 connecting ear-plate on lifting beam
9 shoulder beam
91 via hole
92 connecting ear-plate
93 bound plate
10 hydraulic lifter
11 base of push instrument kit
111 base body of push instrument kit
112 expansion member
113 ear-plate
12 rotatable support
121 spherical convex
122 load-bearing member
13 steel strand
14 baffle
15 second push instrument kit

DETAILED EMBODIMENTS

As shown in FIGS. 1 to 4, a construction apparatus for lifting structure integrally over the obstacles in vertical direction to a position with different horizontal projection, according to the present invention, comprises two platform beams 5 that placed each other in parallel with a certain distance, two lifting beams 8 laterally relative to the platform beams, that placed on platform beams 5, and hydraulic lifters 10 that equipped on lifting beams 8. A plurality of pairs of baffles 14 are installed on both sides of slide rails 6 of the platform beams 5, as well as on top surface of the lifting beams 8, and the interval between each pair of baffles 14 corresponds with a pace of push instrument kit 15.

A slide rail 6 is arranged between the platform beam 5 and the lifting beam 8 in order to facilitate the lifting beam 8 moving; The hydraulic lifter 10 is welded onto the shoulder beam 9. First push instrument kit 7 is installed on the platform beam 5, each first push instrument kit comprises a head connected to a connecting ear-plate 81 of the lifting beam 8, a body, and a base 11 used to connect to and sustain the body, the base 11 of first push instrument kit is supported on the baffles 14 installed on the platform beam 5, and the baffles 14 could provide the first push instrument kit 7 with a counter-force to push the lifting beam forward when the first push instrument kit 7 works, meanwhile, the interval between adjacent baffles 14 matches with a pace of the hydraulic push instrument kit 7. Second hydraulic push instrument kit 15 is placed on the lifting beam 8, the head of the push instrument kit is connected to the connecting ear-plate 92 of the shoulder beam 9, and the body of push instrument kit is connected to the base 11 of push instrument kit which is supported on the corresponding baffles 14 installed on the lifting beam 8, and the baffles 14 could provide the second push instrument kit 15 with a counter-force to push the shoulder beam 9 forward when the second push instrument kit 15 works, meanwhile, the interval between adjacent baffles 14 matches with a pace of the hydraulic push instrument kit 15; Therefore, the structure 1 to be lifted can horizontally move freely under the act of the first and second push instrument kits.

A steel strand 13 of the hydraulic lifter 10 is connected to the lifting lug 4 configured at the structure 1 to be lifted, this is because it can prevent the steel strand 13 from folding while lifting the structure 1, and be convenient to load or unload the structure.

Further, in order to prevent the steel strand 13 from folding slightly and damaging while lifting the structure 1, due to the construction's delay relative to the move of the hydraulic lifter 10, a rotatable support 12 is arranged between the shoulder beam 9 and the lifter 10.

Figure 4:
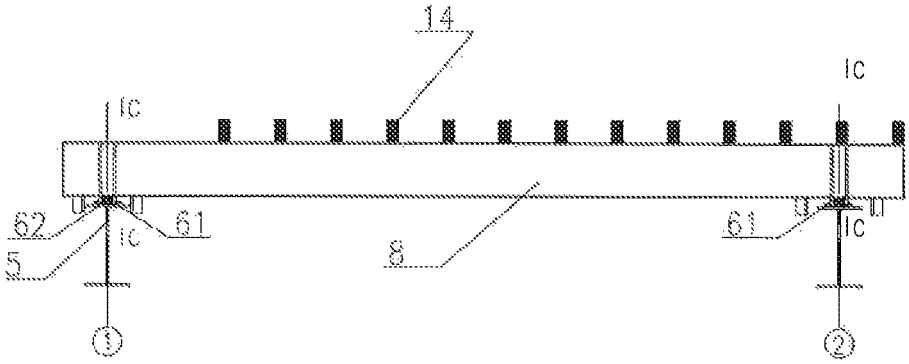
FIG. 4 is a schematic view of the lifting beam according to the present invention.
Figure 5:
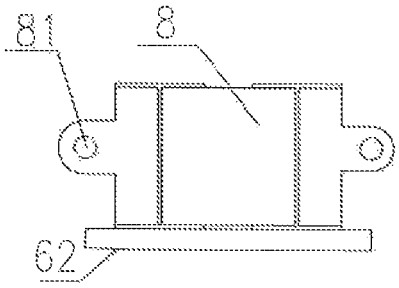
FIG. 5 is a C-C view of FIG. 4.
Figure 6:
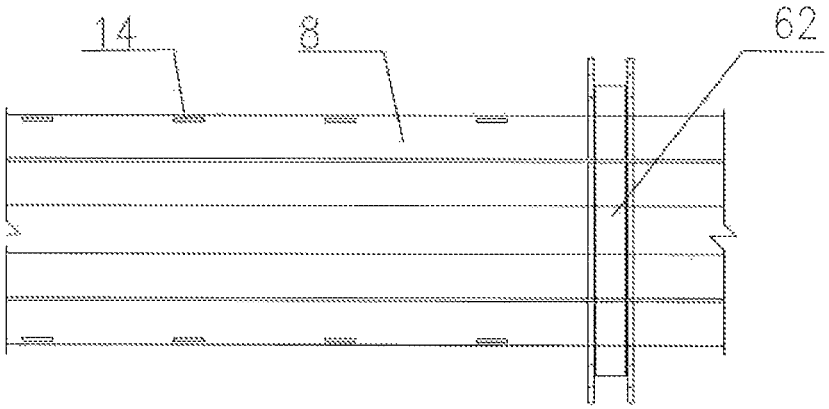
FIG. 6 is a top view of FIG. 4.

As shown in FIGS. 4 to 6, the slide rail 6 between the platform beam 5 and the lifting beam 8 comprises a slide groove 61 fixed to the platform beam 5, and a slider 62 fixed to the lifting beam, the slider 62 can be slid in the slide groove 61, the accessible area between the slider 62 and the slide groove is smooth plane with polishing treatment and lubricating grease.

The lifting beams 8 are double-beams structured in which each is configured as "工"-shaped at a certain distance where the steel strand 13 of hydraulic lifter 10 could pass through, ear-plates 81 used to connect to the first push instrument kits 7 are arranged on the lifting beams 8, and spread outward.

Figure 7:
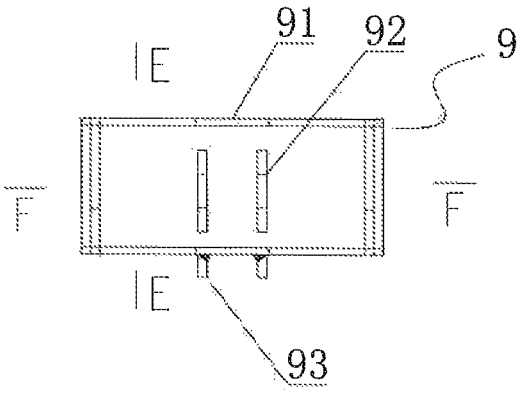
FIG. 7 is a schematic view of the shoulder beam according to the present invention.
Figure 8:
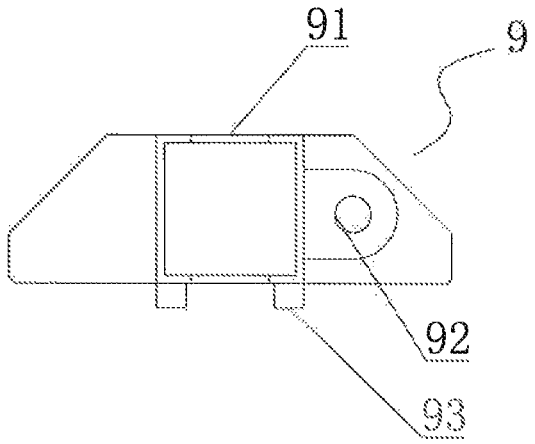
FIG. 8 is an E-E view of FIG. 7.
Figure 9:
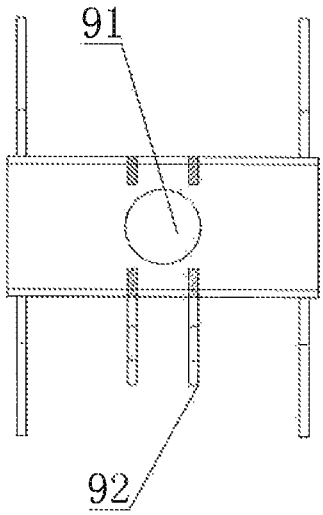
FIG. 9 is an F-F view of FIG. 7.

As shown in FIGS. 7 to 9, the shoulder beam 9 is a box structure equipped with a via hole 91, the connecting ear-plates 92 and the bound plates 93, wherein a steel strand 13 can pass through the via hole 91, and the connecting ear-plate 92 is configured at the sides of the box structure and spread outward to connect to the second push instrument kit 15, and a bound plates 93 are configured at the bottom of the box structure so as to prevent steel strand 13 from folding when it pass through the via hole 91.

Figure 10:
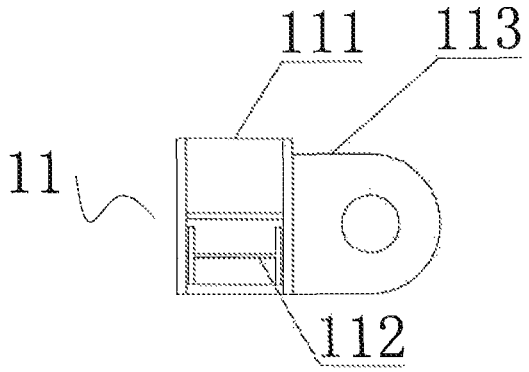
FIG. 10 is a schematic view of base of the push instrument kit according to the present invention.
Figure 11:
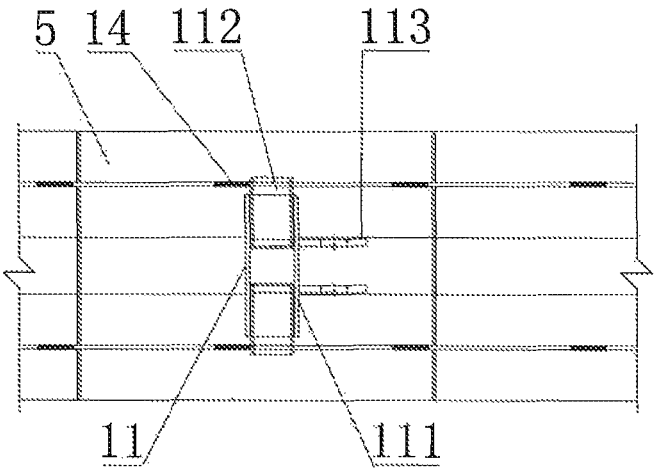
FIG. 11 is a top view of the base of the push instrument kit in use according to the present invention.

As shown in FIGS. 10 to 11, the base of the push instrument kit 11 comprises a base body 111, expansion members 112 placed at both sides of the base body, and ear-plates 113 spread outward from the base body 111 that used to connect to the push instrument body. The base body 111 of the push instrument kit is "H"-shaped and its width is less than the distance between each pair of baffles 14 set on both sides of platform beam. The expansion members 112 are also "H"-shaped and extend outward to support on the baffles 14 on both sides of platform beam.

Figure 12:
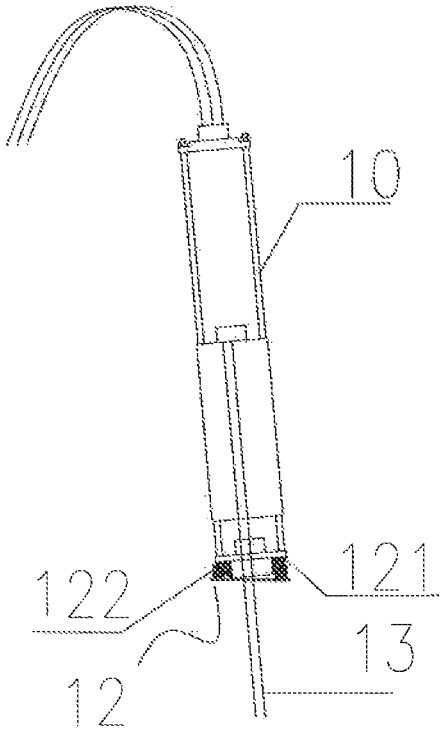
FIG. 12 is a schematic view of rotatable support between the hydraulic lifter and the shoulder beam according to the present invention.

As shown in FIG. 12, said rotatable support 12 comprises spherical convex 121 fixed to the base of hydraulic lifter 10, and load-bearing member 122 fixed to the surface of the shoulder beam 9. The load-bearing member has a spherical concave facing to and matching with the spherical convex 121. When the lifter 10 moves, the construction would be delayed relative to the move of the hydraulic lifter 10, and the steel strand 13 would be folded slightly. However the spherical convex 121 will rotate freely in the spherical concave under the act of the steel strand 13, the hydraulic lifter 10 will adjust the steel strand 13 to be vertical, and prevent the steel strand 13 from damaging.

A method for lifting structure integrally over the obstacles in vertical direction to a position having a different horizontal projection, comprising the steps of:

(1) assembling the structure 1 that to be lifted on the proper position of a construction site and setting lifting lugs 4 onto the suitable positions of the structure 1 according to the construction requirements;

(2) arranging two platform beams 5 longitudinally above the structure 1 to be lifted, setting a slide rail 6 to each platform beam 5, and fixing a slide groove 61 to each platform beam 5;

(3) placing two lifting beams 8 on the platform beams 5 laterally, fixing a slider 62 onto the bottom of the lifting beam 8, and the slider 62 will be placed into the slide groove 61 correspondently;

(4) Installing the first hydraulic push instrument kits 7 on the platform beams 5, wherein the head of the push instrument kit 7 is connected to the lifting beam 8, the body of the push instrument kit 7 is connected to the base 11 of the push instrument kit 7 which is support on the corresponding baffles 14 on both sides of platform beam 5;

(5) Installing shoulder beams 9 and second hydraulic push instrument kits 15 onto the lifting beams 8, wherein the head of the push instrument kit 15 is connected to the shoulder beam 9, the body of the push instrument kit 15 is connected to the base 11 of push instrument kit 15 which is supported on the corresponding pair of baffles 14 on the lifting beam 8, and a hydraulic lifter 10 is arranged on the shoulder beam 9;

(6) connecting the hydraulic lifter 10 to the lifting lug 4 on the structure 1 to be lifted by means of a lifting steel strand 13, while lifting the structure 1, the height between both ends of the structure 1 can be increased, and the horizontal projection of the structure 1 will be reduced only if adjusting the hydraulic lifters 10 arranged at two lifting beams 8 and the first hydraulic push instrument kits 7 at two platform beams 5, such that the posture of the structure 1 can be altered and the structure 1 can therefore be lifted over the obstacle in vertical direction;

(7) adjusting the height and the horizontal projection once again by operating the hydraulic lifters 10 and the first hydraulic push instrument kits 7 after the structure 1 has already be crossed over the obstacle, and making the structure 1 to be horizontal, then the structure 1 can be lifted to a target height thereafter;

(8) moving the structure 1 to a desired position by operating second hydraulic push instrument kits 15, each pace of the hydraulic push instrument kits 15 should match with the interval between two adjacent baffles 14 installed on the lifting beam 8. Once the push instrument kit 15 works to push at the shoulder beam 9 for a strock, two expansion members 112 placed at both sides of the base body of the push instrument kit 15 will be retracted, such that the push instrument kit 15 can be taken out to next strock, and two expansion members 112 spread outward again to support on the next baffles 14 on the next stroke, and the push instrument kit 15 works again to push at the shoulder beam 9. Such operation can proceed subsequently, until the structure 1 reaches its desired horizontal position; and (9) adjusting the structure 1 slightly by means of hydraulic lifter 10, in order to meet the requirement, and the installation of the structure 1 will be accomplished.

The embodiment described hereinbefore is merely preferred embodiment of the present invention and not for purposes of any restrictions or limitations on the invention. It will be apparent that any non-substantive, obvious alterations or improvement by the technician of this technical field according to the present invention may be incorporated into ambit of claims of the present invention.

What is claimed is:

1. A construction apparatus for lifting a structure integrally over obstacles in a vertical direction to a position with a different horizontal projection, the construction apparatus comprising:

at least two platform beams placed parallel to each other;

at least two lifting beams disposed laterally relative to the at least two platform beams and placed on the at least two platform beams and above the structure;

a slide rail arranged on the at least two platform beams;

a lifter disposed on the at least two lifting beams by means of a shoulder beam;

first push instruments installed on the at least two platform beams to move the at least two lifting beams, each first push instrument comprising:

a head connected to one of the at least two lifting beams;

a body; and a base supporting the body;

second push instruments installed on the at least two lifting beams to move the shoulder beam, the lifter being installed on the shoulder beam, each second push instrument comprising:

a head connected to the shoulder beam;

a body; and a base used to sustain the body;

a first set of baffles installed on both sides of the slide rail in order to provide the first push instruments with a counter-force when the first push instruments work;

a second set of baffles installed on the at least two lifting beams in order to provide the second push instruments with a counter-force when the second push instruments work; and a rotatable support arranged between the shoulder beam and the lifter, the rotatable support comprising:

a spherical convex portion fixed to the base of the lifter; and a load-bearing member fixed to the surface of the shoulder beam, the load-bearing member having a spherical concave portion facing to and matching with the spherical convex portion.

2. The construction apparatus of claim 1, wherein the first set of baffles comprises a plurality of pairs of baffles disposed at intervals, two baffles of each pair are set on both sides of the slide rail respectively, and the second set of baffles comprises a plurality of pairs of baffles disposed at intervals, two baffles of each pair are set on a top surface of the lifting beams.

3. The construction apparatus of claim 2, wherein the base of second push instruments comprises a base body, expansion members placed at both sides of the base body, and ear-plates spread outward from the base body to connect to the body of the second push instrument, wherein the base of the second push instruments is "H"-shaped and a width of the base is less than the distance between two baffles of each pair of baffles on the lifting beam, and the expansion members are "H"-shaped and extend outward to be supported on the pair of baffles on the lifting beam.

4. The construction apparatus of claim 1, wherein the shoulder beam is a box structure equipped with a via hole, connecting ear-plates and bound plates, wherein a steel strand can pass through the via hole, and the connecting ear plates are configured at sides of the box structure and spread outward to connect to the second push instruments and the bound plates are configured at a bottom of the box structure.

5. The construction apparatus of claim 1, wherein the slide rail comprises:

a slide groove fixed to the platform beam; and a slider fixed to the lifting beam, wherein the slider is slidable in the slide groove, and wherein a contact area between the slider and the slide groove is a smooth plane.

6. The construction apparatus of claim 1, wherein the lifting beams are a double-beam structure combined by two strips of "工"-shaped steel, and wherein ear-plates used to connect to the first push instruments are arranged on the lifting beams.

* * * * *